United States Patent [19]

Melzer

[11] Patent Number: 4,960,361

[45] Date of Patent: Oct. 2, 1990

[54] SEPARATING SHEETLIKE STRUCTURES FROM PILES

[75] Inventor: Jaroslav Melzer, Ludwigshafen, Fed. Rep. of Germany

[73] Assignee: BASF Aktiengesellschaft, Ludwigshafen, Fed. Rep. of Germany

[21] Appl. No.: 333,418

[22] Filed: Apr. 5, 1989

[30] Foreign Application Priority Data

Apr. 7, 1988 [DE] Fed. Rep. of Germany ..... 3811634

[51] Int. Cl.[5] ..... B65H 3/00; B65G 59/00

[52] U.S. Cl. ..... 414/786; 414/797; 414/793; 271/18.3

[58] Field of Search ..... 414/793, 797, 789.5, 414/786; 271/18.3, 90, 104, 105

[56] References Cited

U.S. PATENT DOCUMENTS

| | | | |
|---|---|---|---|
| 3,146,902 | 9/1964 | Voelker | 414/797 X |
| 4,361,062 | 11/1982 | Reiff | 414/797 X |

FOREIGN PATENT DOCUMENTS

| | | | |
|---|---|---|---|
| 717097 | 10/1966 | Italy | 414/793 |
| 0052822 | 4/1980 | Japan | 414/797 |
| 0221021 | 10/1986 | Japan | 271/18.3 |

*Primary Examiner*—Robert J. Spar
*Assistant Examiner*—James Teller, Jr.
*Attorney, Agent, or Firm*—Keil & Weinkauf

[57] ABSTRACT

Individual air permeably sheetlike structures are efficiently lifted from a pile by a vacuum lifter and deposited again at a processing station, the pile including as an alternate interlayer a sheet of air impermeable material.

2 Claims, 1 Drawing Sheet

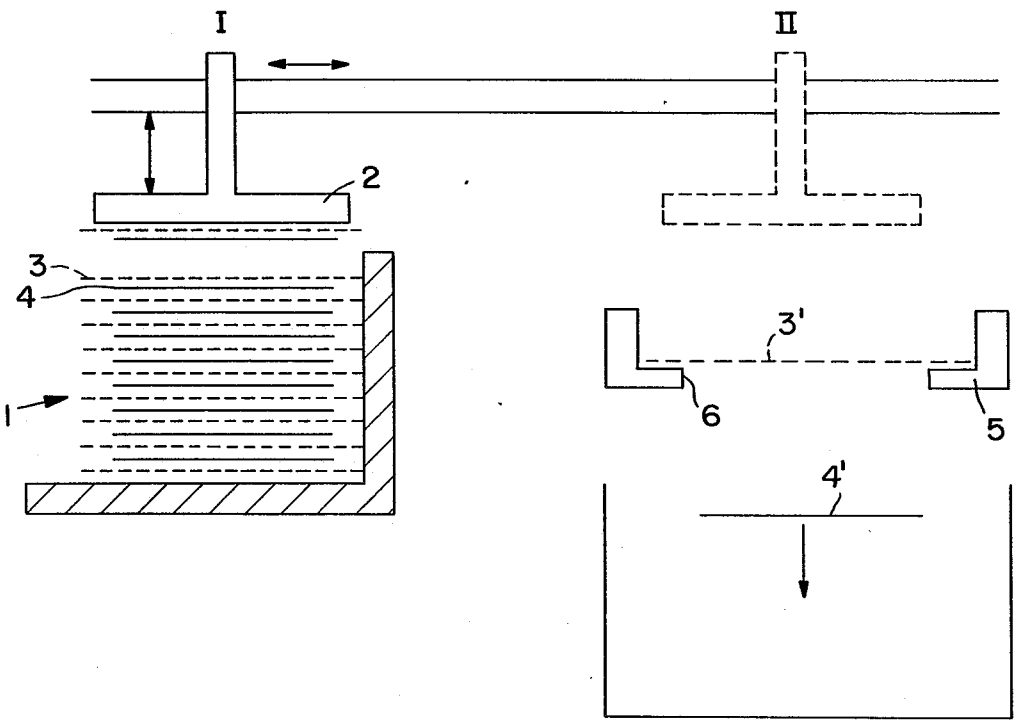
II
I
2
3
4
1
3'
5
6
4'

SEPARATING SHEETLIKE STRUCTURES FROM PILES

The present invention relates to a process for separating a sheetlike structure from a pile where the structure is picked up by means of a vacuum lifter, transported to a processing station, and released again there.

The use of vacuum lifters presupposes that the structures, such as paper or textile samples for example, are to be introduced mechanically into measuring equipment or as individual pieces into finishing or printing machines, are identical in constitution, in particular in porosity and density. If, however, the individual structures vary in these properties, satisfactory pickup from the pile is no longer guaranteed. This is because for a specific setting of the lifting vacuum it is no longer guaranteed, as a consequence of varying air permeability of the structures, that only one sample or piece will be picked up at a time.

SUMMARY OF THE INVENTION

It is an object of the present invention to provide a process for separating a sheetlike structure from a pile where reliable separation is ensured regardless of the constitution of the structure.

We have found that this object is achieved by a process of the type described at the beginning if the pile of sheetlike structures has been assembled with an alternate interlayer of a sheet of air impermeable material.

BRIEF DESCRIPTION OF THE DRAWINGS

FIG. 1 shows schematically an apparatus for separating sheetlike structure from piles.

DESCRIPTION OF THE PREFERRED EMBODIMENT

In what follows, the process is further explained by means of an illustrative embodiment shown in the accompanying drawing, this drawing showing in a schematic way how the process according to the invention can be carried into practice.

The sheetlike structures 3, such as sheets or disks of paper or textile material, are assembled into a pile 1 alternately with sheets 4 made of an air impermeable material, for example plastics sheeting or metal foil. The pile at the location I serves as a stock reservoir for processing stations, for example II, to be supplied with the structures, such as measuring means or finishing or printing machines. The individual structures are transported to these stations by means of a suction lifter 2 in coordinated pivoting and lifting movements. The reduced pressure exerted by the lifter is set in such a way that even in the case of structures 3 of little porosity the intermediate sheet 4 is attracted as well. As the structure, here denoted 3; is laid onto the processing surface 5, the smaller sheet, here denoted 4; then drops, when the reduced pressure is switched off, into a correspondingly dimensioned opening 6 in the surface 5. Structure and interlayer are accordingly separated again.

I claim:

1. A process for separating sheetlike structures of air permeable material from a pile by vacuum lifting, said process comprising the steps of assembling said pile by interleaving said structures of air permeable material in alternating sequence, with interlayer sheets of air impermeable material, vacuum lifting each said structure from said pile together with the respective underlying one of said air impermeable interlayer sheets, transporting any given one of said lifted structures together with its respective underlying interlayer sheet to a processing station, releasing said structure and said interlayer sheet, and separating said interlayer sheet from said structure.

2. A process as claimed in claim 1, wherein said interlayer sheets are of smaller dimensions that said structures, and wherein in said releasing step, said structure and underlying sheet are dropped onto a surface having a bottom opening of predetermined size such that said interlayer sheet is allowed to pass downwardly through said opening whereas said structure is retained by said surface.

* * * * *